United States Patent [19]

Koski et al.

[11] 4,440,598

[45] Apr. 3, 1984

[54] PRESS SECTION IN A PAPER MACHINE

[75] Inventors: Erkki Koski; Olli Tapio, both of Jyväskylä, Finland

[73] Assignee: Valmet Oy, Finland

[21] Appl. No.: 287,299

[22] Filed: Jul. 27, 1981

[30] Foreign Application Priority Data

May 7, 1981 [FI] Finland ..... 811403

[51] Int. Cl.[3] ..... D21F 3/04; D21F 3/08

[52] U.S. Cl. ..... 162/305; 162/359; 162/360

[58] Field of Search ..... 162/205, 191, 305, 306, 162/360, 358, 359, 274, 275

[56] References Cited

U.S. PATENT DOCUMENTS

| | | | |
|---|---|---|---|
| 4,056,433 | 11/1977 | Koponen et al. | 162/360 |
| 4,163,688 | 8/1979 | Kankaanpaa | 162/359 |
| 4,192,711 | 3/1980 | Tapio et al. | 162/359 |
| 4,209,361 | 6/1980 | Kankaanpaa | 162/205 |
| 4,224,104 | 9/1980 | Kankaanpaa | 162/360 |
| 4,257,844 | 3/1981 | Schmitt et al. | 162/305 |

*Primary Examiner*—Steve Alvo

*Attorney, Agent, or Firm*—Steinberg & Raskin

[57] ABSTRACT

A press section in a paper machine includes a first double felted press nip defined by first and second rolls through which first upper and second lower felt fabrics pass and at least two single felted press nips defined with a plain surface roll, the first felt fabric passing through a first one of the single felted press nips. The press section includes only non-suction rolls, the first and second rolls defining the first double felted press nip each having a solid shell and recessed surface. The first felt fabric supports the web leaving the wire section and is guided over a first sector of the first recessed surface roll wherein the direction thereof is changed so as to be directed generally upwardly prior to the first double felted press nip. The second lower felt fabric which passes through the first double felted press nip is guided over a second sector of the first recessed surface roll which comprises at least a substantial portion of the first sector thereof to provide external support for the web. The second felt fabric is separated from the web substantially immediately after the first double felted press nip whereupon the first felt fabric and web supported thereby is conducted to and passes through the first single felted press nip, the web then detaching from the first felt fabric and adhering to the surface of the plain surface roll for subsequent passage through the second single felted press nip.

18 Claims, 4 Drawing Figures

PRESS SECTION IN A PAPER MACHINE

BACKGROUND OF THE INVENTION

The present invention relates generally to a no-draw press section for a paper machine and a method of pressing a web in such a press section.

More particularly, the present invention relates to a no-draw press section in which a paper web leaving the wire section of the paper machine is supported by a first felt fabric and is conducted between two felt fabrics through a first double felted press nip which is defined by two press rolls having recessed surfaces and in which dewatering from the paper web takes place through both web surfaces. The press section includes a plain surface roll against which at least two single felted press nips are defined, the first of which is located at a given distance from the first double felted press nip. The first felt fabric also serves as a pressing fabric in the first single felted press nip. The paper web travels between the first double felted press nip and the first single felted press nip carried by the first felt fabric and separates therefrom after passing through the first single felted press nip whereupon the web adheres to the surface of the plain surface roll and is transferred on that surface to the second single felted press nip, the latter being provided with its own felt fabric.

The starting point in the development of the press section of the present invention comprises the "Sym-Press" press section manufactured by Valmet Oy of Finland in view of the several years of experience obtained in the operation thereof.

The construction of a "Sym-Press" press section is disclosed in Finnish publication print No. 50651 and U.S. Pat. No. 4,209,361. Generally, the "Sym-Press" press section constitutes a compact, so-called fully closed press section in which a paper web coming from the forming wire of the paper machine is conducted between two felts through a first press nip which is defined between two rolls including recessed surface rolls and/or suction rolls, so that dewatering of the paper web takes place through both of its surfaces. The press section includes a plain surface roll which is provided with at least one doctor device. A second press nip is defined by the plain surface roll and the second of the two rolls defining the first press nip whereby dewatering takes place in the second press nip through the surface of the paper web which faces the second roll of the first press nip. At least one additional press nip is defined between the plain surface central roll which has a larger diameter than that of the other press rolls of the press section and a recessed surface roll, a felt being passed through such additional press nip, the latter being located on a side of the central plain surface roll which is substantially opposite to the location of the second press nip.

Reference is made to U.S. Pat. No. 4,257,844 as well as to articles published in the following magazines "Das Papier" Heft 1 pages 33–44, 1981 and "Norsk Skogindustri" No. 3, page 80, 1974, with respect to the state of the art relating to the present invention.

A modification of the "Sym-Press" press section described above is described in the last mentioned publications. In such modification the suction roll of the "Sym-Press" does not define a press nip with the plain surface central roll, a first double-felted press nip of the press section being arranged in connection with this suction roll or preceding it and in which dewatering the web takes place in two directions. A recessed surface press roll is substituted for a suction roll of the "Sym-Press" and defines a second press nip of the press section in conjunction with the plain surface central roll. The third press nip is formed against the plain surface central roll on a side thereof which is substantially opposite to the second press nip.

It has been necessary to use a suction roll either as a press roll or as a roll on which the web is carried by a pick-up felt to change the direction of the felt run upwardly towards the second nip. The use of a suction roll or other equivalent suction device has several considerable disadvantages discussed in detail below.

More particularly, the perforations of a suction roll may leave a marking on the paper web which detracts from the appearance of the paper and may affect the surface characteristics of the paper as well. Suction rolls are expensive, each requiring an individual drive motor and associated control system. It is well known that the operation of suction rolls generate significant noise levels and, furthermore, large quantities of air are consumed due to the fact that not only does the air which passes through the web and felt enter the suction system but, additionally, the air which arrives in the suction zone of the suction roll in the shell perforations in each revolution must also enter into the suction system. Additionally, the sealing of the suction box of the suction roll causes many difficulties in practice.

As is well known, a suction roll comprises a rotating perforated cylindrical shell and a stationary suction box situated within the shell which faces and sealingly engages by means of sealing elements the inner side of the cylindrical shell. The suction box generally extends axially from one end of the shell to the other end and has a suction width of about 100–500 mm. The suction box is connected to a suction system so that a flow of air is obtained through the shell perforations on that area thereof which is in communication with the suction box while the roll is rotating. As noted above, suction rolls are expensive components of a paper machine resulting from the fact that the drilling of the shell is a difficult task, among other reasons. The perforations reduce the strength of the shell and, therefore, special metal alloys must be used in the construction of the roll shell and the latter must have a relatively large thickness, all contributing to high material costs.

The amount of air carried in the shell perforations into the suction zone and which therefore enter the suction system has been found to be unexpectedly great in modern high speed paper machines. It follows that the higher the speed of the paper machine, the greater will be the proportion of "hole air" which enters the suction system together with the drying air. This proportion is even further increased by the fact that with increasing machine speeds, the roll shells must be of even greater thickness to provide increased strength, it being understood that the amount of "hole air" is proportional to the thickness of the roll shell.

As also pointed out above, another drawback encountered in the operation of suction rolls is the generation of high noise levels which can cause severe health risks for the operators if certain measures are not taken to avoid such noise. The generation of such high noise levels results from the fact that the perforations formed in the suction roll shell act as whistles. In other words, as the perforations which are subjected to the vacuum in the suction zone travel beyond the suction zone, the same are abruptly filled with air thereby causing a loud whistling noise having a basic frequency equivalent to the acoustical resonating frequency of the hole. The whistle system constituted by the multitude of roll perforations often creates a noise whose level exceeds the pain limit of the human ear. Although attempts have been made to attenuate this noise level by various arrangements, such as by employing a suitable drilling pattern for the perforations, a satisfactory attenuation of this noise has not been achieved in practice.

Another disadvantage in the use of suction rolls is that it is often desirable to provide deflection compensation, especially when such suction rolls are utilized as press rolls. However, the provision of such deflection compensation is not possible as a rule since the suction roll shell is perforated and/or due to the fact that the interior of the roll is occupied by the suction box to such an extent that it is not possible to accommodate conventional deflection compensation apparatus in the roll interior.

Further pertaining to the state of the art relating to the present invention, reference is made to U.S. Pat. No. 4,192,711 in which a method is disclosed for detaching a paper web from a forming wire and conducting it in a so-called closed, no-draw conduction to the press section and for accomplishing a dewatering pressing process. The method disclosed in this patent basically comprises the following steps in sequence:

(a) a felt is conducted onto the web lying on the forming wire, which felt is conducted over the suction slot or slots of a transfer suction box, the web being subjected to a suction effect and the direction of the run of the felt and of the web lying thereon deviated with respect to the run of the forming wire;

(b) the web carried by the felt is conducted around a grooved and/or perforated roll located within the loop of that felt over a substantially large sector on which the web is subjected to an external steam treatment by which the web (and possibly the felt underneath the web) on the roll is heated, the web being supported externally during its change of direction on the roll;

(c) the heated web is then conducted on the felt into the first press nip in which the web is pressed between a recessed surface roll and a plain surface roll for the purpose of dewatering; and (d) after detachment from the felt, the web is conducted onto the surface of the plain surface roll.

SUMMARY OF THE INVENTION

Accordingly, one object of the present invention is to provide new and improved press apparatus and methods wherein no suction rolls or at least no suction press rolls are required.

Another object of the present invention is to provide new and improved press apparatus and methods in a paper machine in which the web can be conducted to and through the press section in a reliable manner in a no-draw conduction without the risk of web breakage.

Still another object of the present invention is to provide new and improved press apparatus and methods which maintain the advantageous features of the "Sym-Press" press section.

A further object of the present invention is to provide new and improved press apparatus and methods wherein the noise level generated during operation is reduced.

A still further object of the present invention is to provide new and improved press apparatus and methods which further those objects presented in U.S. Pat. No. 4,192,711.

Briefly, in accordance with the present invention, these and other objects are attained by providing press apparatus and methods wherein the press section operates only with non-suction rolls and wherein a first double felted press nip is defined between two rolls having a solid shell and a recessed surface.

A first or upper felt fabric which supports the paper web leaving the wire section of the paper machine is guided with the web supported thereby over a first sector of the first recessed surface roll whereby the direction thereof is changed so as to be directed generally upwardly prior to the first double felted press nip, the magnitude of the first sector being in the range of about 30° to 150°.

A second or lower felt fabric which also passes through the first double felted press nip is guided over a second sector of the first recessed surface roll which comprises at least a substantial portion of the first sector of the first recessed surface roll to provide external support for the web over the second sector. The second or lower felt fabric is separated from the web substantially immediately after the first double felted press nip.

It will be understood that the term "press felt fabric" as used in the instant application refers to all felt-like products made of artificial or natural fibers and which are conventionally used in paper machines and particularly in their press sections, to either improve the dewatering from the web or for carrying the web from one treatment location to another.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
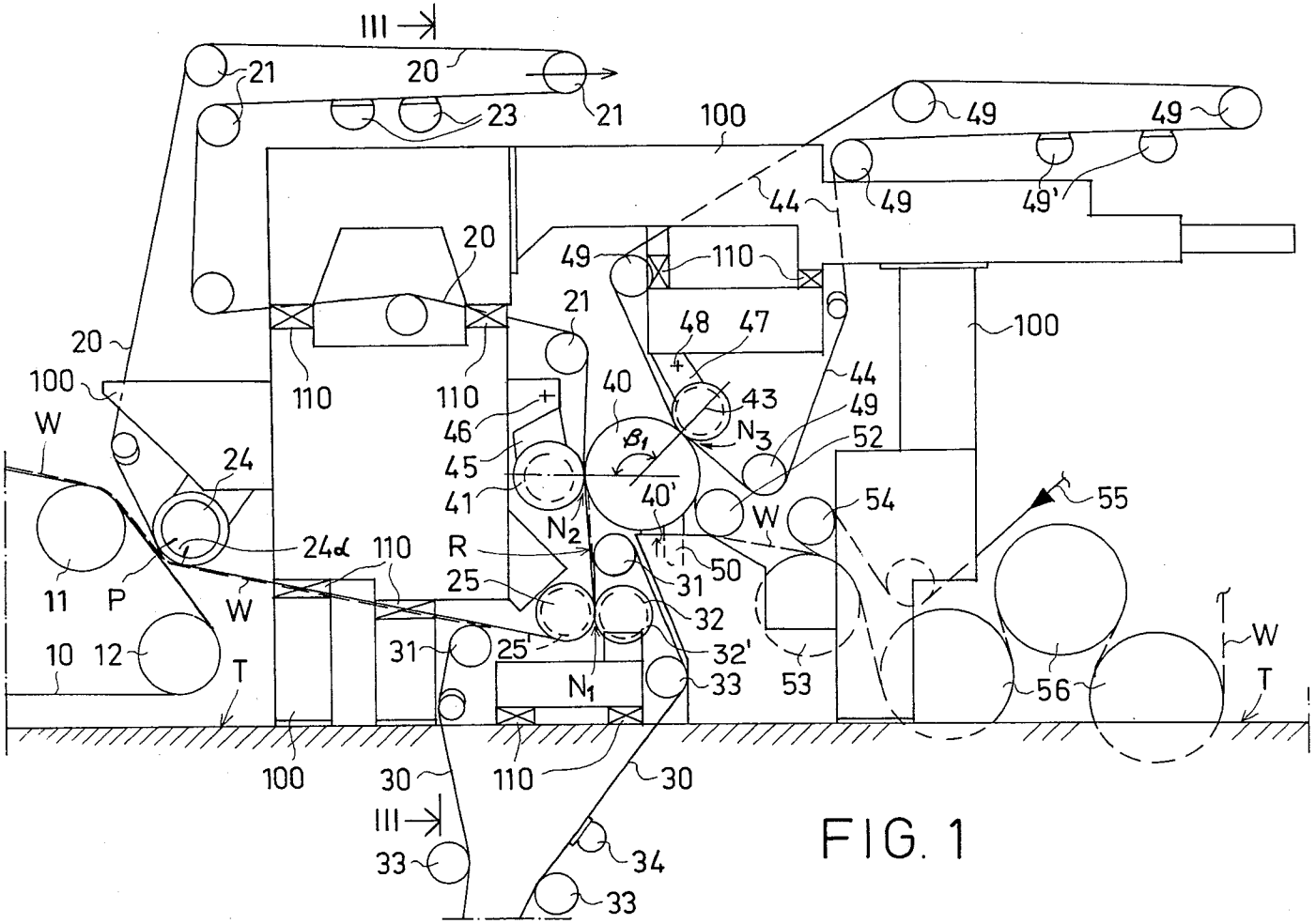
FIG. 1 is a schematic elevation view of one embodiment of the press apparatus of the present invention.
Figure 2:
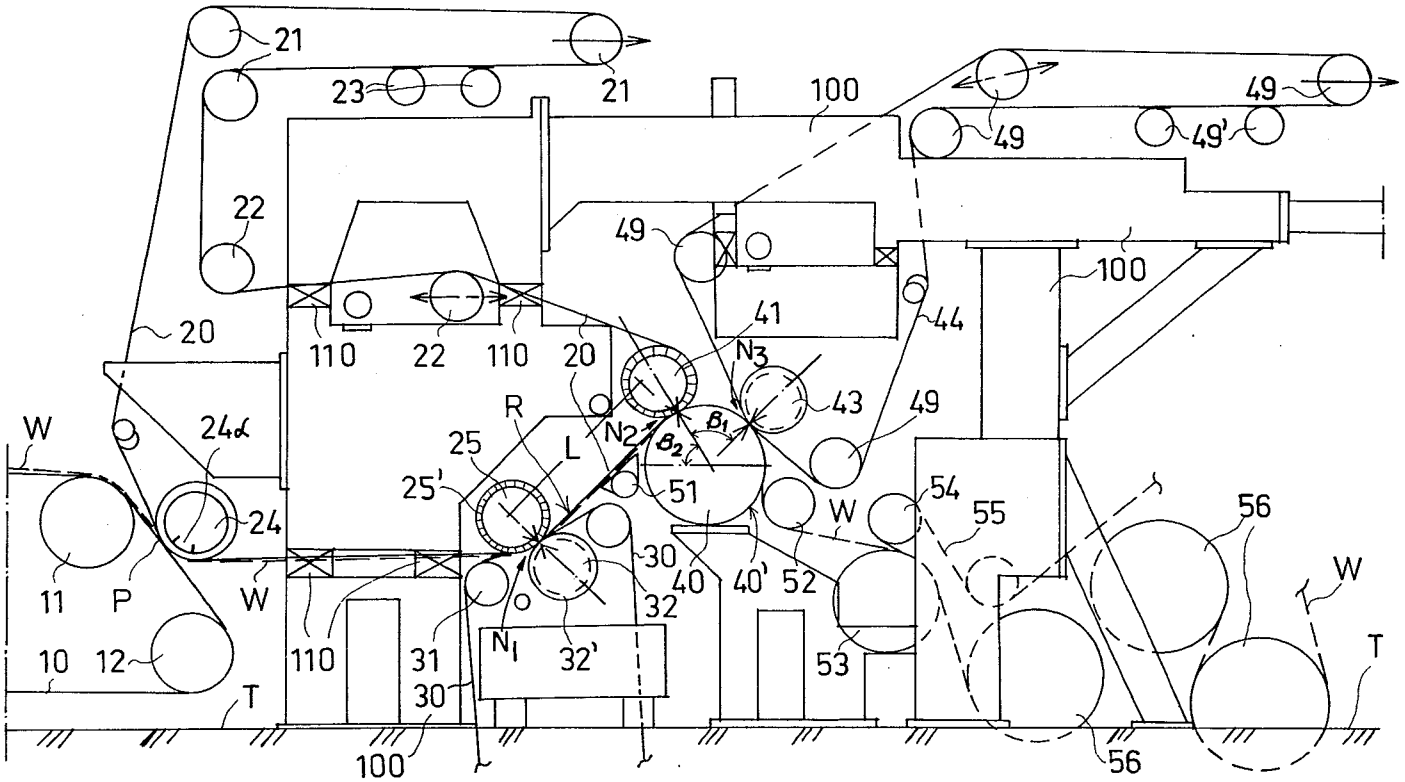
FIG. 2 is a view similar to FIG. 1 illustrating a second embodiment of the present invention.

Referring now to the drawings wherein like reference characters designate identical or corresponding parts throughout the several views, in both of the embodiments illustrated in FIGS. 1 and 2, a web W entering the press section is formed on a wire 10 from which web W is detached at point P located on a downwardly sloping run of the wire between rolls 11 and 12 and is transferred by means of a suction sector 24 $\alpha$ of a pick-up roll 24 onto a first or upper fabric felt 20. In addition to serving as a pick-up fabric, the first fabric felt 20 operates as a press felt in a first press nip $N_1$ and in a second press nip $N_2$ of the press section.

After passing through the first press nip $N_1$, the first fabric 20 is directed generally upwardly on a run R and the web W supported thereby is transferred to the second nip $N_2$. The first felt fabric 20 also passes through the second nip $N_2$ and functions as a press fabric therein.

The second nip $N_2$ is defined between a plain surface central roll 40 and a press roll 41 having a recessed surface. The plain surface central roll 40 preferably has a larger radius than that of the other press rolls and may, for example, constitute a granite roll. In this connection, the use of a granite roll is advantageous in that the adhesion of the web to the surface of the roll 40 will be stronger than the adhesion of the web to the fabric 20 while at the same time the web can be easily detached from the surface of the granite roll utilizing the speed differential as the web is transferred from the press section to the drying section of the paper machine. A third press nip $N_3$ is defined by a press roll 43 having a recessed surface and the central roll 40. The roll 43 is provided with a separate fabric loop 44. The guide rolls for the fabric loop 44 are indicated by reference numeral 49 and the felt conditioning means therefore by reference numeral 49'. The guide rolls of the first felt fabric 20 are indicated by reference numeral 21 and corresponding felt conditioning means by reference numeral 23.

The first press nip $N_1$ is defined between press rolls 25 and 32 and constitutes a double felted nip, i.e., two felt fabrics passed therethrough. The first felt fabric 20 serves as an upper felt while a felt fabric 30 operates as a lower felt which is guided by rolls 31 and 33. The guide rolls of the lower felt fabric 30 which are situated below the floor level T are indicated by reference numeral 33 and the corresponding felt conditioning means by reference numeral 34.

One of the important features of the present invention, among others, is that there is no need for expensive suction rolls or other equivalent suction devices in the dewatering press nips. This is accomplished by defining the first press nip $N_1$ between two recessed surface press rolls 25 and 32. The nip $N_1$ is double felted and the web W enters the nip adhered to the lower surface of the first felt fabric 20. The second fabric in nip $N_1$ is the second felt 30 or other equivalent fabric enclosing the press roll 32.

The plain surface central roll 40 is mounted by means of bearings fixed in the frame structure 100 of the paper machine. A downwardly open sector 40' substantially opposite to the nips $N_2$ and $N_3$ is provided with a doctor device 50 as shown in FIG. 1. In case of web breakage during operation, the paper web is guided by the doctor device 50 into a broke pulper (not shown) which is situated below the press section.

The paper web W is detached from the surface of the plain surface central roll 40 by utilizing the speed differential between the press section and the dryer section and is guided by the guide roll 52 which conducts the web W into the drying section of the paper machine. A lead-in cylinder 53 is illustrated in FIGS. 1 and 2 as are drying cylinders 56 of the dryer section. A single fabric web conduction system comprising a fabric 55 guided by guide rolls 54 can be advantageously utilized in the dryer section.

Figure 3:
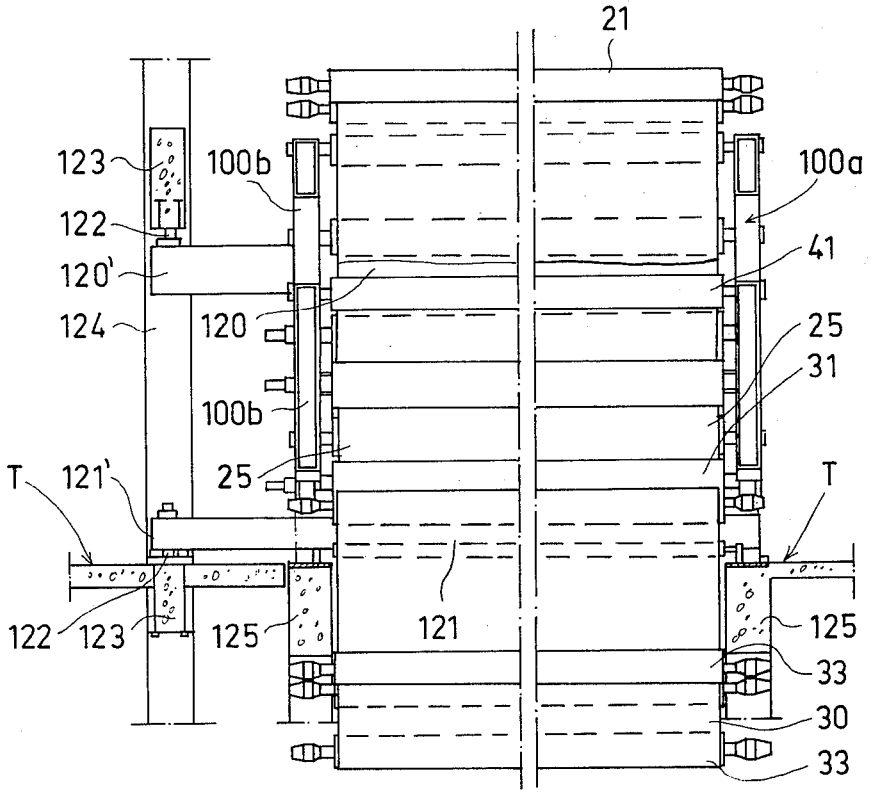
FIG. 3 is a section view taken along line III—III of FIG. 1.

The frame 100 of the paper machine is indicated by reference numeral 100 in FIGS. 1–3. Intermediate frame members 110, known per se, are provided in the frame 100 and in the vertical columns 100*a* (FIG. 3) thereof, which intermediate members can be detached to facilitate changing of the felt fabrics 20 and 30.

Referring to FIG. 3, a sectional view of one part of the frame 100 of the press section is illustrated comprising beams 120 and 121 which are supported at one of their ends by cantilever extensions 120' and 121'. Such support is accomplished by means of rods 122 and horizontal beams 123. Of vertical columns 100*a* and 100*b*, the latter constitute the drive side of the press section. Side beams 125 are located on both sides of the paper machine below the floor level T.

The press section of the present invention described above constitutes an improvement on the so-called "Sym-Press" press section described above. As is known, the "Sym-Press" press section is a compact one in which the nips between each pair of rolls form a continuous series and in which there is only a single press suction roll. The press section according to the present invention accomplishes a no-draw conduction of the web but is not as compact in the same sense as the "Sym-Press" press section. It is noted that neither one of the press rolls defining the first double felted nip $N_1$ is in contact with any rolls defining the second nip $N_2$. However, the press section of the present invention can be considered to constitute a compact press construction since the space requirements, especially in the horizontal direction, are not substantially greater than those required by a conventional "Sym-Press" press section.

In conventional press sections according to the prior art discussed above, the roll corresponding to the roll 25 of the present invention has generally been constituted by a suction roll which, by means of its suction sector, retains the web attached to a felt corresponding to the felt fabric 20 as the direction of run of the same changes.

Figure 4:
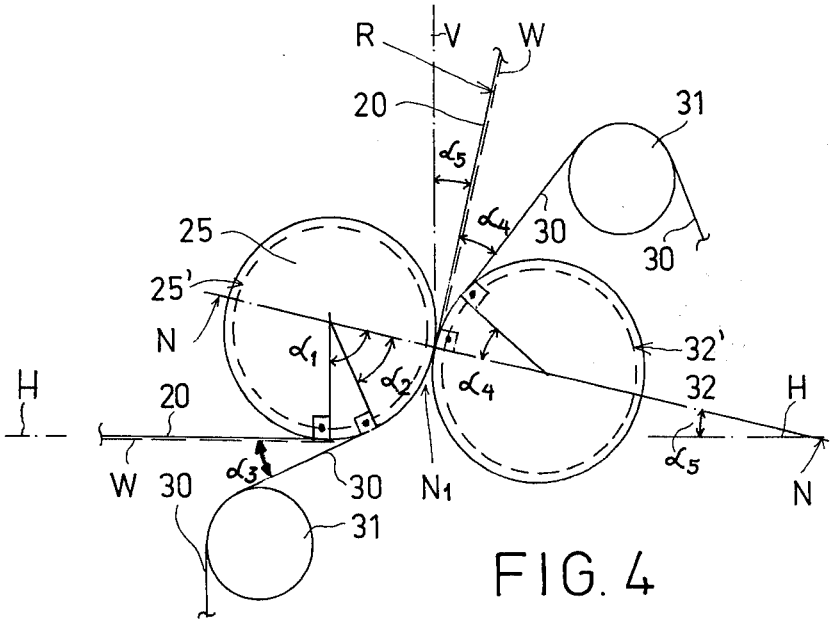
FIG. 4 is a schematic detail view illustrating the geometry of the rolls and fabrics in the first double felted press nip of the present invention.

Referring now to FIG. 4, the particular parameters defining the geometry of the first double felted press nip $N_1$ are illustrated. It is important to note that as the first felt fabric 20 and the web W supported thereby change the direction of their run on the press roll 25 over a sector $\alpha_1$, the web is subjected on this sector to a centrifugal force which tends to detach the web W from the fabric 20. However, according to the present invention, the use of a suction roll has been avoided by guiding the second felt fabric 30 over a second sector $\alpha_2$ of the press roll 25, the second sector $\alpha_2$ comprising at least a substantial portion of the first sector $\alpha_1$. Thus, the second felt fabric 30 which passes through the first nip $N_1$ follows and supports the web W carried on the fabric 20 over a sector $\alpha_2$ within the sector $\alpha_1$. As seen in FIG. 4, the fabric 20 and the web supported thereby are conducted in the nip $N_1$ substantially at right angles to the plane N-N which passes through the axes of rolls 25 and 32. In other words, the fabric 20 and web W supported thereby depart from the first double felted press nip $N_1$ tangentially with respect to rolls 25 and 32 forming the same. After the nip $N_1$, the second felt fabric 30 wraps the press roll 32 over a sector $\alpha_4$. As illustrated in FIG. 2, the angle $\alpha_1$ constituting the change of direction undergone by the first felt fabric 20 and web W supported thereby can be relatively small whereby the height of the press section is also correspondingly small. A consequence of this construction, however, is that the length of the press section may become somewhat longer than that of the embodiment illustrated in FIG. 1 wherein the change of direction undergone by the first felt fabric and web supported thereby is larger.

The embodiments of the press section illustrated in FIGS. 1 and 2 differ in several respects. Thus, firstly, in the embodiment illustrated in FIG. 1, the plane N-N which passes through the axes of press rolls 25 and 32 is substantially horizontal and the run R of the first felt fabric 20 between the nips $N_1$ and $N_2$ is substantially vertical so that the angle $\alpha_1$ illustrated in FIG. 4 is slightly larger than 90° with respect to the horizontal plane H-H.

In practice, the angle $\alpha_1$ may have a magnitude of about 150°. According to the embodiment of FIG. 1, the second felt fabric 30 guides and supports the web W lying on the fabric 20 substantially over the entire sector $\alpha_1$ so that as seen in FIG. 4, the angle $\alpha_3=0$. As will be apparent from the geometry indicated in FIG. 4, the angle $\alpha_3=\alpha_1-\alpha_2$. Thus, the change of direction in the run of the web W which is supported by the fabric 20 at the press roll 25 according to the invention is accomplished between felt fabrics 20 and 30 so that any risk of detachment of the web W from the fabric 20 under centrifugal force is eliminated. In the embodiment illustrated in FIG. 1, the angle $\alpha_4$ shown in FIG. 4 is very small due to the location of the guide roll 31. Again referring to FIG. 4, the angle $\alpha_5=90°-\alpha_1$.

On the other hand, in the embodiment of the invention illustrated in FIG. 2, the angle $\alpha_1$ is about 45° and under some circumstances the angle $\alpha_1$ may be as small as about 30°.

Referring to FIG. 2, the second press nip $N_2$ forms a central angle $\beta_2$ with the horizontal through the axis of the central roll 40. The angle $\beta_2$ preferably has a magnitude of about 45°. The third nip press nip $N_3$ is located at an angle $\beta_1$ from the second nip $N_2$. In the embodiment of FIG. 2, the angle $\beta_1$ is about 90°. In the embodiment of FIG. 1, the nip $N_2$ is located substantially in a horizontal plane which passes through the rotational axis of the central roll 40 while the nip $N_3$ is spaced from the nip $N_2$ by an angle $\beta_1$. In the embodiment of FIG. 1, the angle $\beta_1$ is about 120°.

The embodiments of the invention illustrated in FIGS. 1 and 2 essentially represent the extremes in the construction of the invention with respect to the magnitude of the angle $\beta_1$ which is important from the point of view of the invention. Thus, the embodiment illustrated in FIG. 1 is advantageous in that the press section requires relatively little space in the horizontal direction while the height of the press section is relatively great since the distance L between the first and second nips is substantially vertical. Although the angle $\alpha_1$ which represents the extent of the change of direction of the web run is relatively large in the embodiment of FIG. 1, no substantial difficulties are presented even though suction rolls are not utilized since the second or lower felt fabric 30 provides external support for the web W while the same runs on the fabric 20.

The angles $\alpha_1 \ldots \alpha_5$ can be chosen within the scope of the invention in a manner such that the transfer and pressing of the web is optimized. It is again pointed out that the press rolls 25, 32, 40, 41 and 43 each comprise a non-suction roll. More particularly, the rolls 25 and 32 can constitute rolls having a recessed surface, i.e., either grooved or blind drilled or the like. The recessed nature of rolls 25 and 32 is indicated by reference numerals 25' and 32', respectively. One or both of the rolls 25 and 32 can, if necessary, constitute a roll provided with a soft covering such, for example, as rubber. Preferably, the roll 25 has a soft covering while the roll 32 constitutes a hard roll so that in this manner a sufficient width in the running direction of the web W is accomplished in the nip $N_1$. Of course, the time during which the web dwells in the nip under pressure is proportional to the width of the nip. The nip width can also be increased utilizing a felt having sufficient compressibility. The press rolls 41 and 43 may also constitute recessed surface rolls such, for example, as grooved or blind drilled rolls. Additionally, rolls 41 and 43 preferably are provided with deflection compensation and controlling apparatus. In this connection, the rolls 25 and 32 may, if necessary, be provided with deflection compensation or deflection controlling apparatus.

The manner in which the felt fabrics 20 and 30 are guided after the nip $N_1$, i.e., the magnitude of the angle $\alpha_4$ in FIG. 4, depends, for example, on the rewetting tendency of the web W. This phenomenon can be minimized through suitable guidance of the run of the fabrics 20 and 30 after the nip $N_1$.

A steam box 51 is illustrated in FIG. 2 which is situated on the run of the fabric 20 between nips $N_1$ and $N_2$ and which faces the web W. By means of the steam box 51, the temperature of the web can be raised in order to improve dewatering in the nips $N_2$ and $N_3$. As to the construction, operation and effect of the steam box 51, reference is made to U.S. Pat. No. 4,163,688.

As seen in FIGS. 1 and 2, the web W is detached from the wire 10 at a point P by means of a pick-up suction roll 24 having a suction zone 24α. If it is desired to provide that the entire wet end of the paper machine be formed of non-suction rolls to thereby minimize to the greatest extent possible the suction energy required and noise levels generated, the suction roll 24 can be replaced by a transfer suction box, such as the type disclosed in the above-mentioned U.S. Pat. No. 4,192,711.

From the above, it is seen that by suitably choosing the angle $\alpha_1$ through which the fabric 20 and web W supported thereon changes direction, it is possible to effectively determine the amount of space required for the press section in both vertical and horizontal directions. The magnitude of the angle $\alpha_1$ also determines the height at which the second press nip $N_2$ is located with respect to the central roll 40, i.e., the angle $\beta_2$ seen in FIG. 2. The embodiment of the invention illustrated in FIG. 1 is advantageous in that the angle $\beta_1$ can be relatively large so that the arcuate distance between the nips $N_2$ and $N_3$ can be quite large. Thus, the angle $\beta_1$ may be about 180° which constitutes the most advantageous construction when the loading directed on the granite central roll 40 is considered. The embodiment according to FIG. 1 in which $\alpha_1$ is greater than 90° and the run of felt 20 and web W supported thereby is guided somewhat obliquely backwardly with respect to the main direction of the web run is also favorable in that it is possible, if necessary, to provide three or more press nips with the central roll 40 while still providing the downwardly facing open sector 40' for the central roll 40 with sufficient space to accommodate a doctor device 50 for cleaning the roll surface for directing the broke downwardly in the case of web breakage.

In the embodiments of FIGS. 1 and 2, the press rolls 25 and 40 are mounted in fixed bearing supports. The central plain surface roll 40 is illustrated as being supported by structure located beneath the same. However, it is understood that this roll may also be supported from above by means of bearing supports fixed to the frame. The rolls 32, 41 and 43 are supported by rods provided with loading devices known per se in order to provide a suitable linear nip pressure in the nips $N_1$, $N_2$ and $N_3$. For example, rods 45 and 47 which are fixed to the framework 100 by means of joint pins 46 and 48, respectively, constitutes such supporting means.

It is known in the art that a web will always adhere in a single felted nip to the surface of the smooth press roll and in a double felted nip on the surface of that felt which is smoother, absent the effect of suction which may act in the press nip or an unclean felt.

An important consideration in the present invention is to assure that a situation does not occur wherein the web W will not follow the upper fabric felt 20 and therefore not pass into the second nip $N_2$ but become attached onto the lower felt fabric 30 of the first nip $N_1$, such as due to the possibility that the lower felt fabric 30 is dirty. In order to eliminate this possibility, all felts and fabrics and particularly the lower fabric 30 must be provided with effective cleaning and felt conditioning devices known per se.

Furthermore, in order to assure a safe conduction of the web W from the first nip $N_1$ to the second press nip $N_2$, it is necessary to closely consider the quality and type of the felts and fabrics 20 and 30 which are utilized. In this connection, primary consideration must be paid to the manner in which the felts and fabrics are manufactured, i.e., to the particular textile technology.

In order to obtain the object of the invention, the pick-up felt 20 belonging to the press section and operating in the first press nip $N_1$ as an upper felt fabric must have two basic characteristics. Firstly, the surface of this upper felt fabric 20 must be considerably smoother than the surface of the second or lower fabric 30 present in the first nip. Secondly, the upper fabric felt 20 must be especially compressible and particularly elastic so that when the felt 20 is released from the pressure between the rolls of the first nip $N_1$, the same expands relatively strongly so that its yarn structure becomes relatively open. The consequence of this action is that a slight suction effect is created which contributes to the attachment of the web W onto the felt fabric 20 in addition to the adhesive forces created by the smooth surface of the fabric 20. By means of the structure and characteristics of such a felt fabric 20, it is possible to assure the adherence of the web W to the upper felt fabric 20 after the first nip $N_1$ and a reliable transfer of the web W to the second nip $N_2$.

To accentuate the effect of the above characteristics of the pick-up fabric felt 20, the second or lower fabric felt 30 present in the first nip $N_1$ must be relatively hard and have a coarse surface while also having an open structure so as to possess sufficient capability to receive water in the pressing process.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A no-draw press section of a paper machine comprising:

a first double felted press nip defined by first and second rolls through which first upper and second lower felt fabrics pass, a paper web leaving the wire section of the paper machine being supported by the first felt fabric and conducted through the first double felted press nip between said two felt fabrics so that the web is dewatered through both of its surfaces in said first double felted press nip;

at least two single felted press nips defined against a plain surface roll, said first felt fabric passing through a first one of said single felted press nips to serve as a press fabric therein, said first single felted press nip being situated at a given distance from said first double felted press nip, the first felt fabric and paper web supported thereby having a run between the first double felted press nip and the first single felted press nip whereupon the web separates from said first felt fabric after passing through said first single felted press nip and adheres to the surface of said plain surface roll and is conducted on said surface to a second one of said single felted press nips through which a separate third press felt passes;

said press section including only non-suction rolls and wherein said first and second rolls each have a solid shell and a recessed surface;

said first upper felt fabric which constitutes a fabric loop and the web supported thereby being guided over a first sector of said first recessed surface roll which is prior to said first double felted press nip and located inside said first felt fabric loop such that the direction of the run of said first felt fabric which wraps said first sector of said first recessed surface roll and the web supported thereby is changed so as to be directed generally upwardly prior to said first double felted press nip, the magnitude of said first sector being in the range of about 30° to 150°; and said second lower felt fabric which passes through said first double felted press nip being guided over a second sector of said first recessed surface roll which is substantially as large as or only slightly smaller than said first sector of said first recessed surface roll to provide external support for the web prior to said first double felted press nip, said second felt fabric being separated from the web substantially immediately after said first double felted press nip.

2. The combination of claim 1 wherein said first sector of said first recessed surface roll on which the direction of said first felt fabric and the web supported thereby is changed has a magnitude such that the run of the first felt fabric and the web supported thereby between said first double felted press nip and said first single felted nip is substantially vertical.

3. The combination of claim 2 wherein said first sector has a magnitude of about 90°.

4. The combination of claim 2 wherein said first single felted press nip which is defined with said plain surface roll is located substantially in a horizontal plane which passes through the axis of said plain surface roll.

5. The combination of claim 4 wherein the arcuate distance between said first single felted press nip and said second single felted press nip, i.e., the central angle of said plain surface roll defined between said nips, is in the range of about 90° to 180°.

6. The combination of claim 5 wherein said central angle is about 90°.

7. The combination of claim 5 wherein said central angle is about 120°.

8. The combination of claim 1 wherein said plain surface roll has a downwardly facing substantially open sector and further including doctor means for cleaning the surface of said plain surface roll and for conducting paper broke in case of web breakage into a pulper or the like.

9. The combination of claim 1 wherein said first sector of said first recessed surface roll on which the direction of said first felt fabric and the web supported thereby is changed has a magnitude in the range of about 30° to 60° and wherein said first double felted press nip is followed by the upward run of said first felt fabric and the web supported thereby and wherein the first single felted press nip is located at a distance of a certain angle from a horizontal plane which passes through the axis of said plain surface roll, said certain angle being in the range of about 30° to 90°.

10. The combination of claim 1 further including means for heating the web situated on said run of said first felt fabric and the web supported thereby between said first double felted press nip and said first single felted press nip whereby the web and water contained therein are heated to reduce the viscosity of the water and thereby facilitate dewatering of the web in the subsequent press nips.

11. The combination of claim 10 wherein said heating means comprise a steam box or the like.

12. The combination of claim 1 wherein said first felt fabric and web supported thereby are conducted from said first double felted press nip in a direction which forms substantially a right angle with a plane which passes through the axes of said first and second recessed surface rolls which defines said first double felted press nip, and wherein said second lower felt fabric which passes through said first double felt nip is separated by a small angle from the run of said first upper felt and the web supported thereby.

13. The combination of claim 1 wherein said press section constitutes a part of a wet end of the paper machine, said wet end operating only with non-suction rolls, and wherein suction box means are provided for picking up the web from the wire section.

14. The combination of claim 1 wherein felt cleaning and conditioning means are provided for cleaning and conditioning said second lower felt fabric.

15. The combination of claim 14 wherein felt cleaning and conditionin means are provided for cleaning and conditioning all of said felt fabrics.

16. The combination of claim 1 wherein the surface of said first upper felt fabric is considerably smoother than the surface of said second lower felt fabric.

17. The combination of claim 1 wherein said first upper felt fabric is substantially compressible and particularly elastic.

18. The combination of claim 1 wherein said second lower felt fabric is relatively hard, has a coarse surface and an open structure such that it is capable of receiving water in the area of said first nip.

* * * * *